United States Patent [19]

Turek et al.

[11] Patent Number: 4,930,548

[45] Date of Patent: Jun. 5, 1990

[54] BALL-LOCK TIE APPLICATION TOOL AND METHOD OF USE

[75] Inventors: James A. Turek, LaGrange; Roy A. Moody, Flossmoor, both of Ill.

[73] Assignee: Panduit Corp., Tinley Park, Ill.

[21] Appl. No.: 407,582

[22] Filed: Sep. 14, 1989

[51] Int. Cl.[5] ..... B21F 9/02

[52] U.S. Cl. ..... 140/93.4; 140/150

[58] Field of Search ..... 140/93 A, 93.2, 93.4, 140/123.5, 123.6, 150

[56] References Cited

U.S. PATENT DOCUMENTS 3,661,187 5/1972 Caveney et al. .

4,399,592 8/1983 Chopp, Jr. et al. .

*Primary Examiner*—Lowell A. Larson

*Attorney, Agent, or Firm*—Charles R. Wentzel; Mark D. Hilliard

[57] ABSTRACT

A ball-lock tie application tool includes a blade projecting from the front face of the tool disposed to engage a ball-containing finger on the head of the tie. During tensioning of the tie around an object by the tool the blade deforms the finger inwardly against the locking ball which results in a greater retention of the initial tension applied by the tool to the tie.

13 Claims, 4 Drawing Sheets

BALL-LOCK TIE APPLICATION TOOL AND METHOD OF USE

FIELD OF THE INVENTION

The present invention generally relates to tools that apply metal ties to secure elongate articles in a bundle and specifically relates to an improved tool that more tightly secures a metal ball-lock tie to non-resilient bundles.

BACKGROUND OF THE INVENTION

Tools that accept the distal end of a strap of a fastener projecting from the locking head of the fastener, grip the strap and draw the strap away from the head of the fastener to tighten the fastener around an object, are well known. See U.S. Pat. No. 3,661,187 owned by our common assignee, Panduit Corp. which discloses one such tool. This type of tool includes a mechanism that senses the tension applied to the fastener and severs the strap adjacent the head at a preset tension level.

This type of tool is utilized to apply metal ball-lock ties of the type described in U.S. Pat. No. 4,399,592, which patent is owned by our common assignee, Panduit Corp. The locking mechanism of the metal ball-lock tie includes a metal ball contained within the head of the tie that moves along the length of the strap of the tie from a first position that does not interfere with the insertion and tensioning of the strap to a second position that wedges the metal ball against the strap and the head of the tie to lock the strap to the head. This movement of the ball results in a limited release of the preset tension induced in the strap by an application tool.

In numerous applications the small release of the preset tension in the fastener is not great enough to affect the operation of the metal ties, or is offset by the resiliency of the objects being bundled.

In certain applications, for example, where the object around which the metal tie is fastened is a non-resilient metal column, the release of a portion of the preset tension induced in the tie by an application tool results in a loosely applied metal tie.

SUMMARY OF THE INVENTION

It is therefore an object of this invention to provide an improved ball-lock tie application tool and method of use of the tool that eliminates any significant loss of preset tension in a ball-lock tie whereby the ball-lock tie can be securely fastened around non-resilient objects.

In general, the tool of the present invention includes a blade disposed to engage the ball in the head of the tie and displace it into the head as the tool withdraws the strap of the metal tie to tension the fastener around an object.

PREFERRED EMBODIMENT FOR CARRYING OUT THE INVENTION

A tool embodying a concept of the present invention is designated generally by the numeral 20 in the accompanying drawings. Tool 20 functions in the same manner as the tool disclosed in U.S. Pat. No. 3,661,187, which is incorporated herein by reference for all that it teaches and which is owned by our common assignee, Panduit Corp.

Figure 1:
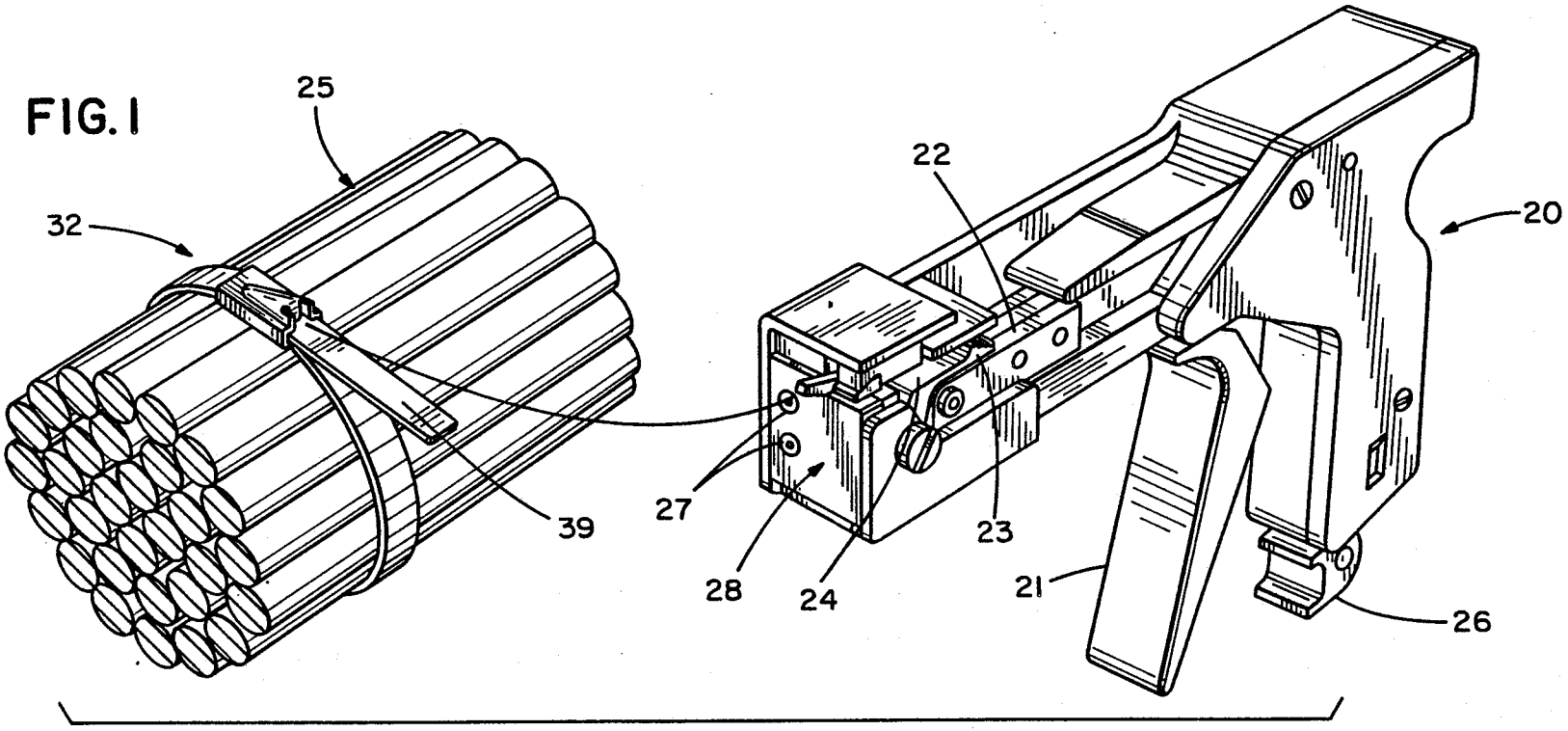
FIG. 1 is a perspective view of a metal ball-lock tie prepositioned around a bundle of wires, adjacent a tool for tensioning the tie which embodies the concept of the present invention.

Tool 20 includes a handle 21 which reciprocally strokes a tension rod 22 carrying a gripper 23. A strap of a fastener inserted within strap positioning slot 24 of tool 20 is engaged by gripper 23 as handle 21 is initially squeezed. As handle 21 is squeezed further, tension rod 22 is retracted to withdraw the strap of the fastener and tension the fastener around an object (illustrated in FIG. 1 as a bundle of wires 25). Tool 20 also includes a mechanism adjusted for the desired preset tension by knob 26 that sense the force applied to the strap of the fastener and automatically engages a strap severing mechanism when a preset level of tension is developed in the fastener.

Figure 2:
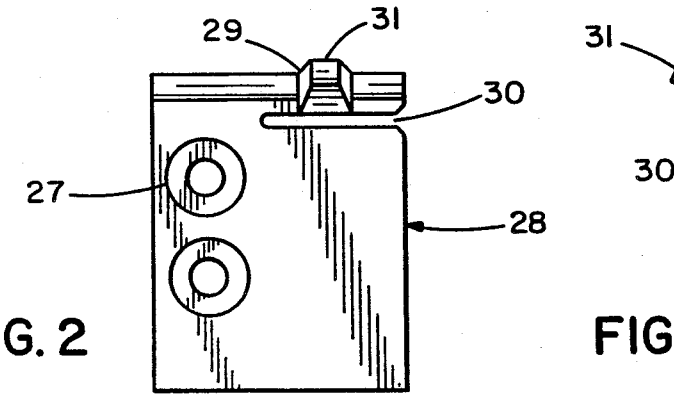
FIG. 2 is a front view of a face plate of the tool of FIG. 1.
Figure 3:
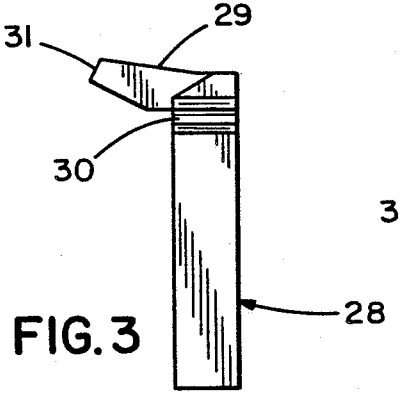
FIG. 3 is a side view of the face plate of FIG. 2.
Figure 4:
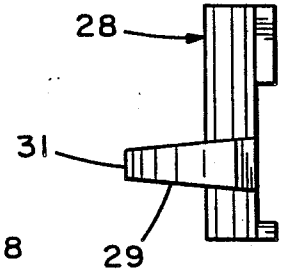
FIG. 4 is a top view of the face plate of FIG. 7.

Attached to the face of tool 20 by bolts 27 is a face plate 28 illustrated in detail in FIGS. 2 through 4. Face plate 28 includes a blade 29 disposed above a strap receiving slot 30 formed in one lateral edge of face plate 28. Blade 29 is contoured to taper to a blunt nose portion 31. Nose portion 31 is positioned above slot 30 and is medially disposed with respect to strap slot 0 such that nose portion 31 is medially disposed relative to the width of a strap positioned within strap slot 30. Strap slot 30 is aligned with slot 24 of tool 20.

Figure 5:
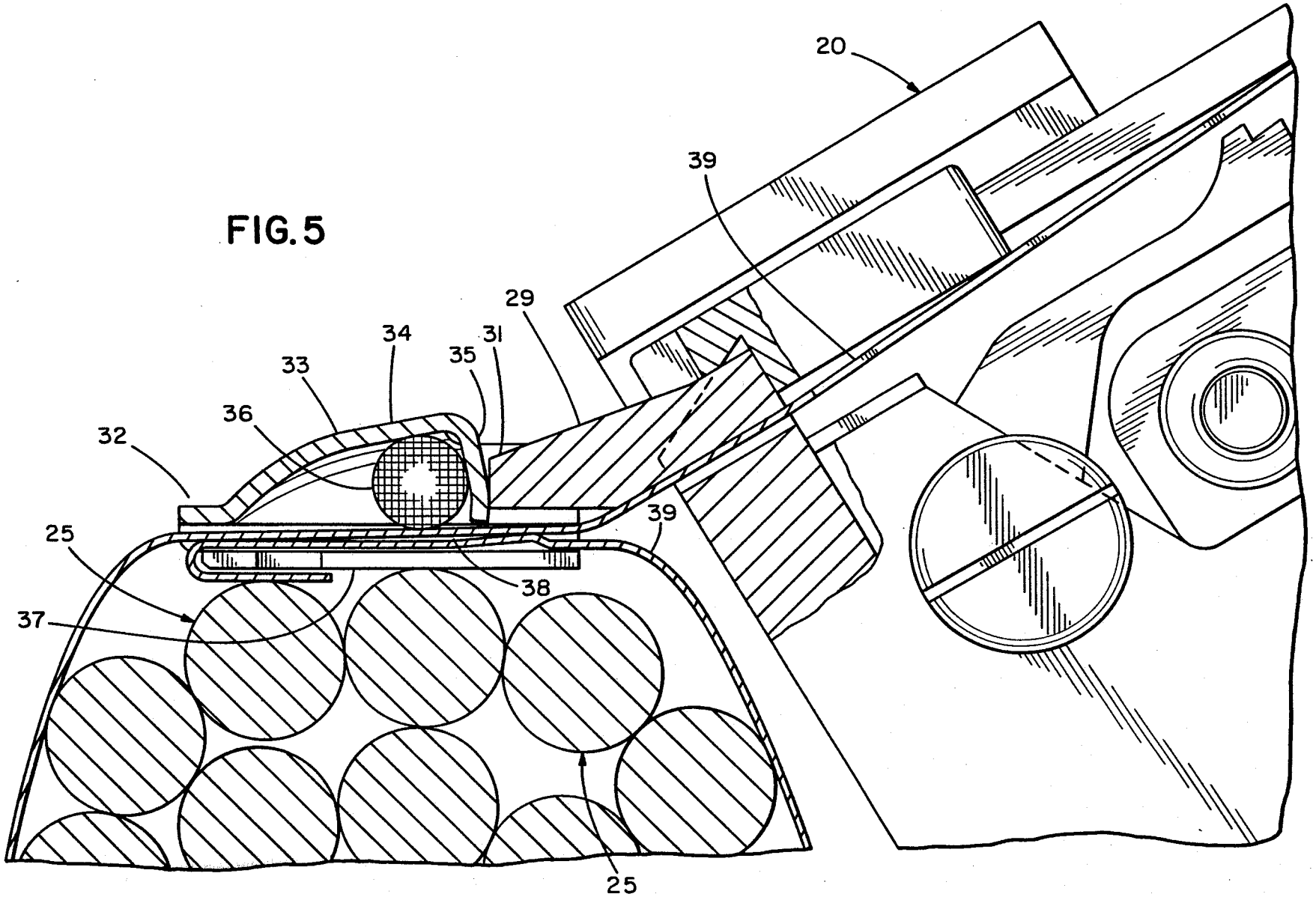
FIG. 5 a fragmentary sectional view of the metal ball-lock tie and tool of FIG. 1 showing the initial pretension position of the tool and tie.
Figure 6:
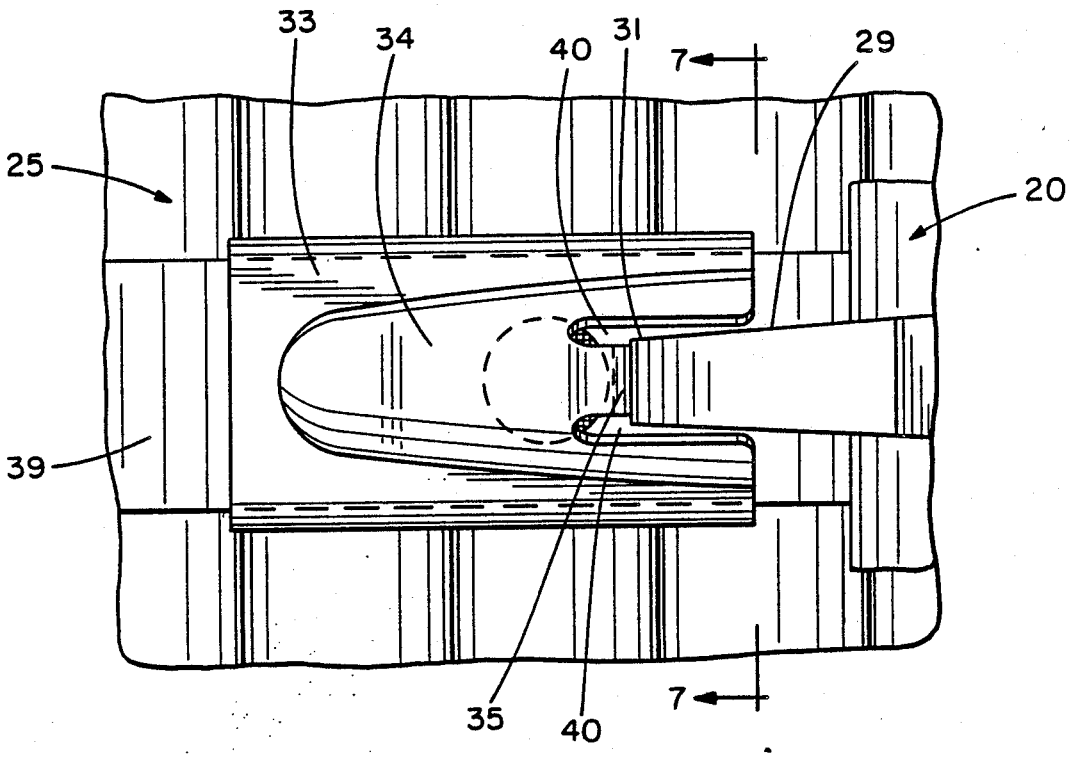
FIG. 6 is a fragmentary top view of the metal tie and tool of FIG. 5.
Figure 7:
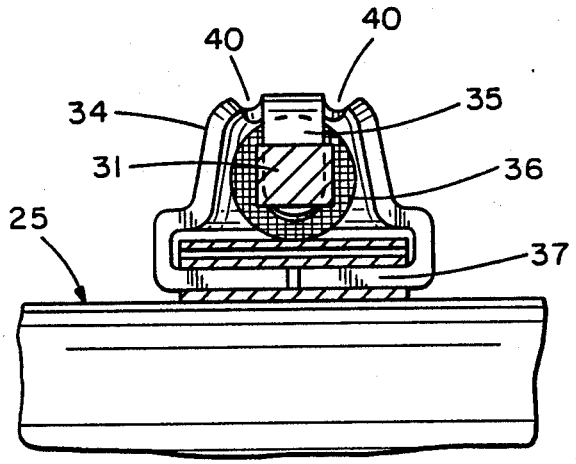
FIG. 7 is a sectional view taken along line 7—7 of FIG. 6.

Tool 20 is especially constructed to apply a metal ball-lock tie, described in detail in U.S. Pat. No. 4,399,592, which is incorporated herein by reference for all that it teaches and which is owned by our common assignee, Panduit Corp. As best seen in FIG. 5, metal tie 32 includes a head 33 having a roof 34 from which projects a finger 35 which captively holds a roller means preferably comprising a spherical ball 36 in head 33 of the fastener. As seen in FIGS. 5, 6 and 7, finger 35 is a cantilever tab projecting from roof 34 toward the bottom wall 37 of head 33. It should be noted that the words ball and ball-lock tie are used herein and in our claims in a generic sense and are specifically intended to include equivalent roller means for locking a strap to a head of a tie and ties incorporating the same. For example, a cylindrical shaped ball means may be substituted for the spherical ball 36 with the proper modifications of head 33.

As best seen in FIG. 5, the ball 36 is initially positioned within head 33 of tie 32, finger 35 containing ball 36 within head 33. A gap 38 exists between overlapped portions of strap 39 which provides clearance in head 33 that allows retrograde movement of ball 36 and strap 39 away from finger 35 when strap 39 is released by tool 20. Thus, ball engagement means should be provided to engage ball 36 during tensioning and move it inward into head 33 in contravention to the movement induced by the adjacent portion of strap 39 which is being withdrawn from head 33 by tool 20 during tensioning; positioning ball 36 such that any significant amount of retrograde movement of ball 36 after release of strap 39 is prevented.

Figure 8:
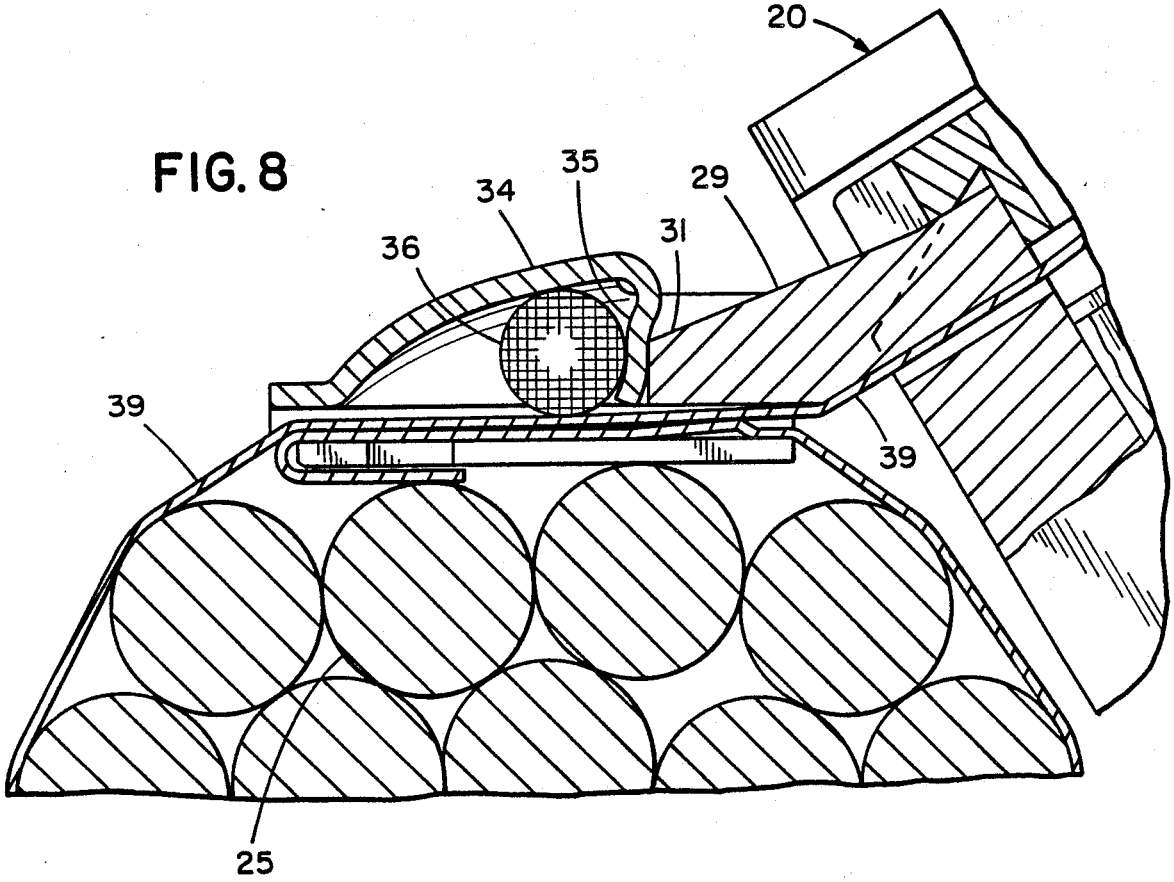
FIG. 8 is a sectional view similar to FIG. 5 showing the position of the tie as the strap is withdrawn and the tie is.
Figure 9:
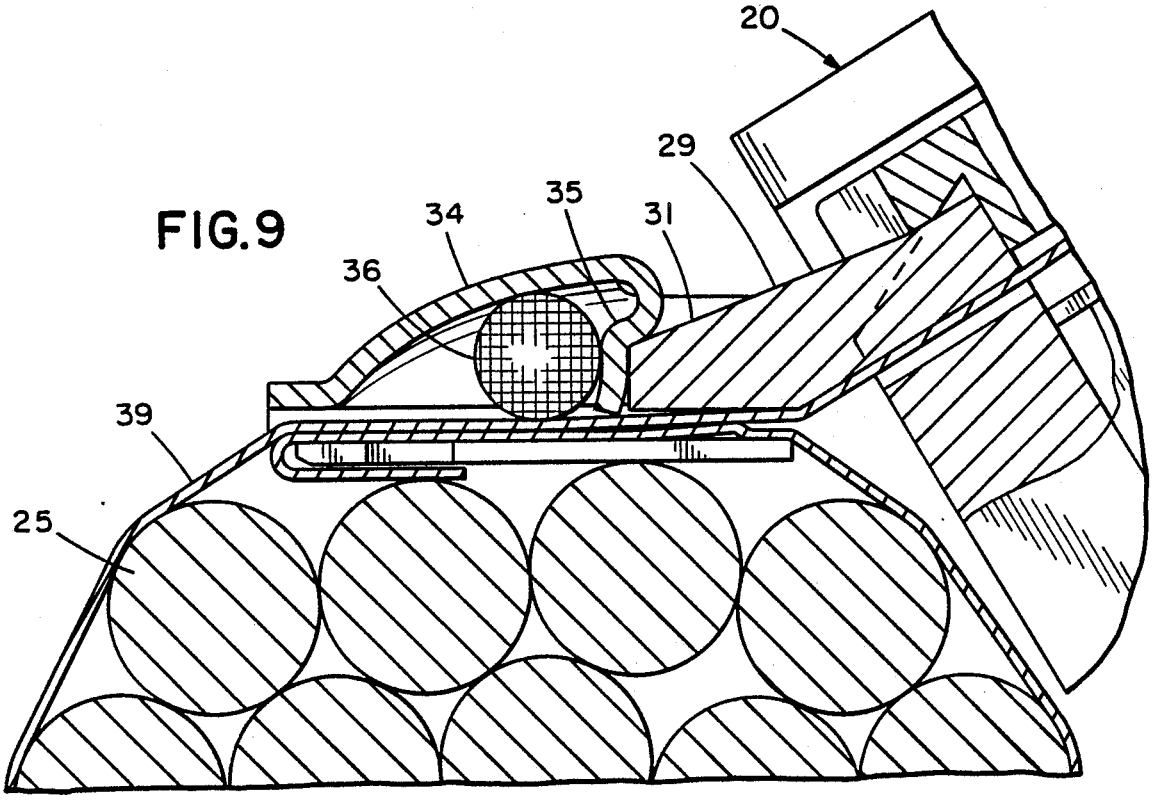
FIG. 9 is a sectional view similar to FIG. 5 showing the final tensioned position of the tool and metal tie.

As best seen in FIGS. 5, 8 and 9, the preferred ball engagement means is blade 29 of tool 20 which is disposed to project from the face of tool 20 such that nose portion 31 of blade 29 engages ball engaging finger 35 when strap 39 of metal tie 32 is positioned within aligned slots 24 and 30 and withdrawn by the tensioning mechanism of tool 20. As seen in FIG. 5, the tool 2 is initially positioned with strap 39 disposed within slots 24 and 30 such that nose portion 31 engages finger 35.

FIG. 8 depicts the deformation induced in finger 35 as strap 39 is withdrawn from head 33 by tool 20 and increased tension is applied to metal tie 32. FIG. 9 depicts the final tension position of deformed finger 35 after tool 20 has withdrawn strap 39 to apply the desired tension to metal tie 32. In the final tension position of FIG. 9, finger 35 has been deformed into engagement with ball 36 wedging ball 36 against roof 34 and bottom wall 37 of head 33 such that any retrograde relative movement of strap 39 is prevented and thus substantially all of the tension applied to metal tie 32 is retained after the severance or release of strap 39 by tool 20.

An alternate embodiment of blade 29, not shown in the drawings, could be a two-pronged fork disposed to present each prong of the fork for entry into the head cavity of tie 32 through openings 40 on either side of finger 35, see FIGS. 6 and 7, to directly engage ball 36 during tensioning and move it inward. In addition, blade 29 could be mounted by a resiliently biased spring means that controls the amount of force applied to finger 35 or ball 36, when used with the alternate embodiment.

Having illustrated and described the principals of our invention with reference to the preferred embodiment, it should be apparent to those skilled in the art that the invention can be modified in arrangement and detail without departing from such principles, for example, tools that utilize structurally different mechanisms actuated by pneumatic, electric or other power sources to apply a fastener can be modified to present a structure equivalent to blade 29 disposed to effect deformation of finger 35 or inward movement of ball 36 during tensioning as herein described. Accordingly, we claim as our invention all such modifications as we come within the spirit and scope of the following claims and equivalents thereof.

We claim:

1. A tie application tool for applying a ball-lock tie having a strap and a locking head enclosing a ball means for locking the strap to the head, comprising:

tensioning means for withdrawing the strap of the tie from the head of the tie to tension the tie around an object; and blade means for engaging the strap locking ball means of the tie and positioning the ball means in the head of the tie such that retrograde movement of the strap after the release of tension by the tool is prevented and substantially all of the tension applied to the tie is retained after release of the strap by the tool.

2. A tool as set forth in claim 1, wherein the blade means is disposed to engage a deformable finger on the head of the tie to deform the finger inwardly into engagement with the ball means.

3. A tool as set forth in claim 2, wherein the blade means is disposed to engage and deform the finger during tensioning of the strap of the tie by the tool.

4. A tool as set forth in claim 2, wherein the blade means projects from the front face of the tool adjacent a strap positioning slot formed in the tool and is medially disposed relative to the width of a strap positioned in the slot of the tool and wherein the ball means is spherically shaped.

5. A tool as set forth in claim 2, including spring biasing means for resiliently biasing the blade to control the amount of force applied to the blade means.

6. A tool as set forth in claim 1, wherein the blade means is shaped to enter openings in the head of the tie and directly engage the ball means of the tie.

7. A tool as set forth in claim 6, wherein the distal end of the blade means is fork shaped.

8. A metal tie application tool for applying a ball-lock tie having a strap and a locking head enclosing a strap locking ball, where the head includes a ball enclosing deformable finger, comprising:

tensioning means for withdrawing a strap of a ball-lock tie from a head of the tie to tension the tie around an object; and a blade projecting from the tool disposed to engage a finger of the tie and deform the finger inwardly into engagement with the locking ball.

9. A tool as set forth in claim 8, wherein the blade means is disposed to engage and deform the finger during tensioning of the strap of the tie by the tool.

10. A tool as set forth in claim 9, wherein the blade means projects from the front face of the tool and is secured adjacent a strap positioning slot formed in the tool and wherein the blade means is medially disposed relative to the width of a strap positioned in the slot of the tool.

11. A tool as set forth in claim 10, including spring biasing means for resiliently biasing the blade to control the amount of force applied to the blade means and wherein the ball is spherically shaped.

12. A method of applying a ball-lock tie having a strap locking head enclosing a strap locking ball means, comprising the steps of:

withdrawing a strap of a ball-lock tie from a locking head of the tie to tension the strap around an object; and engaging a strap locking ball means of the tie and positioning the ball means in the head of the tie such that retrograde movement of the strap after release of tension by the tool is prevented.

13. A method as set forth in claim 12, including the steps of:

providing a tensioning tool for performing the step of withdrawing the strap, wherein a blade is disposed on the tool to engage a finger on the head of the tie which contains the locking ball means; and engaging the finger with the blade and deforming the finger into engagement with the ball means during withdrawal of the strap.

* * * * *